US009932676B2

(12) United States Patent
Ito et al.

(10) Patent No.: US 9,932,676 B2
(45) Date of Patent: Apr. 3, 2018

(54) PRETREATMENT SOLUTION FOR ELECTROLESS PLATING AND ELECTROLESS PLATING METHOD

(71) Applicant: ELECTROPLATING ENGINNERS OF JAPAN LIMITED, Tokyo (JP)

(72) Inventors: Masahiro Ito, Hiratsuka (JP); Yuichi Adachi, Hiratsuka (JP)

(73) Assignee: ELECTROPLATING ENGINEERS OF JAPAN LIMITED, Tokyo (JP)

( * ) Notice: Subject to any disclaimer, the term of this patent is extended or adjusted under 35 U.S.C. 154(b) by 14 days.

(21) Appl. No.: 15/122,548

(22) PCT Filed: Jun. 11, 2015

(86) PCT No.: PCT/JP2015/066849
§ 371 (c)(1),
(2) Date: Aug. 30, 2016

(87) PCT Pub. No.: WO2016/009753
PCT Pub. Date: Jan. 21, 2016

(65) Prior Publication Data

US 2017/0067164 A1 Mar. 9, 2017

(30) Foreign Application Priority Data

Jul. 17, 2014 (JP) ..... 2014-146991

(51) Int. Cl.
*C23C 18/18* (2006.01)
*C23C 18/16* (2006.01)
(Continued)

(52) U.S. Cl.
CPC ..... *C23C 18/18* (2013.01); *C23C 18/1608* (2013.01); *C23C 18/1612* (2013.01);
(Continued)

(58) Field of Classification Search
CPC . C23C 18/18; C23C 18/1608; C23C 18/1612; C23C 18/1633; C23C 18/182;
(Continued)

(56) References Cited

U.S. PATENT DOCUMENTS 3,682,671 A * 8/1972 Zeblisky ..... C23C 18/208 106/1.05
3,993,802 A 11/1976 Polichette et al.
(Continued)

FOREIGN PATENT DOCUMENTS

JP S51-34829 A 3/1976
JP 62235473 A * 10/1987
(Continued)

OTHER PUBLICATIONS

JP S62-235473, Machine Translation, translated 2017, Originally published 1987, p. 1-3 (Year: 2017).*
(Continued)

*Primary Examiner* — Helene Klemanski
(74) *Attorney, Agent, or Firm* — Manabu Kanesaka

(57) ABSTRACT

The pretreatment solution for electroless plating of the present invention is composed of noble metal colloidal nanoparticles, a sugar alcohol, and water. The colloidal nanoparticles are gold, platinum, or palladium, have an average particle diameter of 5 to 80 nm, and are contained in the pretreatment solution in an amount of 0.01 to 10 g/L as metal mass. The sugar alcohol is at least one selected from the group consisting of tritol, tetritol, pentitol, hexitol, heptitol, octitol, inositol, quercitol, or pentaerythritol and is contained in the pretreatment solution in an amount of 0.01 to 200 g/L in total. The electroless plating method of the present invention uses the pretreatment solution and performs the electroless plating in an electroless plating bath.

3 Claims, 1 Drawing Sheet

(51) Int. Cl.

| | |
|---|---|
| ***C23C 18/30*** | (2006.01) |
| ***C23C 18/32*** | (2006.01) |
| ***C23C 18/42*** | (2006.01) |
| ***C23C 18/44*** | (2006.01) |
| ***C23C 18/31*** | (2006.01) |

(52) U.S. Cl.
CPC ..... *C23C 18/1633* (2013.01); *C23C 18/182* (2013.01); *C23C 18/1841* (2013.01); *C23C 18/1868* (2013.01); *C23C 18/1889* (2013.01); *C23C 18/30* (2013.01); *C23C 18/31* (2013.01); *C23C 18/32* (2013.01); *C23C 18/42* (2013.01); *C23C 18/44* (2013.01)

(58) Field of Classification Search
CPC ..... C23C 18/1841; C23C 18/1868; C23C 18/1889; C23C 18/30; C23C 18/32; C23C 18/42; C23C 18/44
USPC ..... 106/1.05, 1.11, 1.18, 1.21, 1.26, 1.28
See application file for complete search history.

(56) References Cited

U.S. PATENT DOCUMENTS 6,010,956 A * 1/2000 Takiguchi ..... H05K 3/0044 438/623
7,166,152 B2 * 1/2007 Okuhama ..... C23C 18/28 106/1.11
2006/0134318 A1 * 6/2006 Hudd ..... C23C 18/1608 427/98.4
2010/0261058 A1 * 10/2010 Lopatin ..... H01M 4/133 429/212
2013/0186672 A1 * 7/2013 Kariya ..... C09D 11/101 174/133 R

FOREIGN PATENT DOCUMENTS

| | | | |
|---|---|---|---|
| JP | S62-235473 | A | 10/1987 |
| JP | H01-319683 | A | 12/1989 |
| JP | 2008-019457 | A | 1/2008 |
| JP | 4649666 | B2 | 3/2011 |

OTHER PUBLICATIONS

Makinen, K.K., "Chapter 11: Sugar Alcohols", from the book "Functional Foods", 1994, p. 219-241 (Year: 1994).*
English translation of the Written Opinion of the International Search Authority dated Aug. 25, 2015 for PCT/JP 2015/066849; 4 pages.*
English translation of JP 01/319683, Dec. 1989; 5 pages.*
PCT International Search Report of PCT/JP2015/066849, dated Aug. 25, 2015.

* cited by examiner

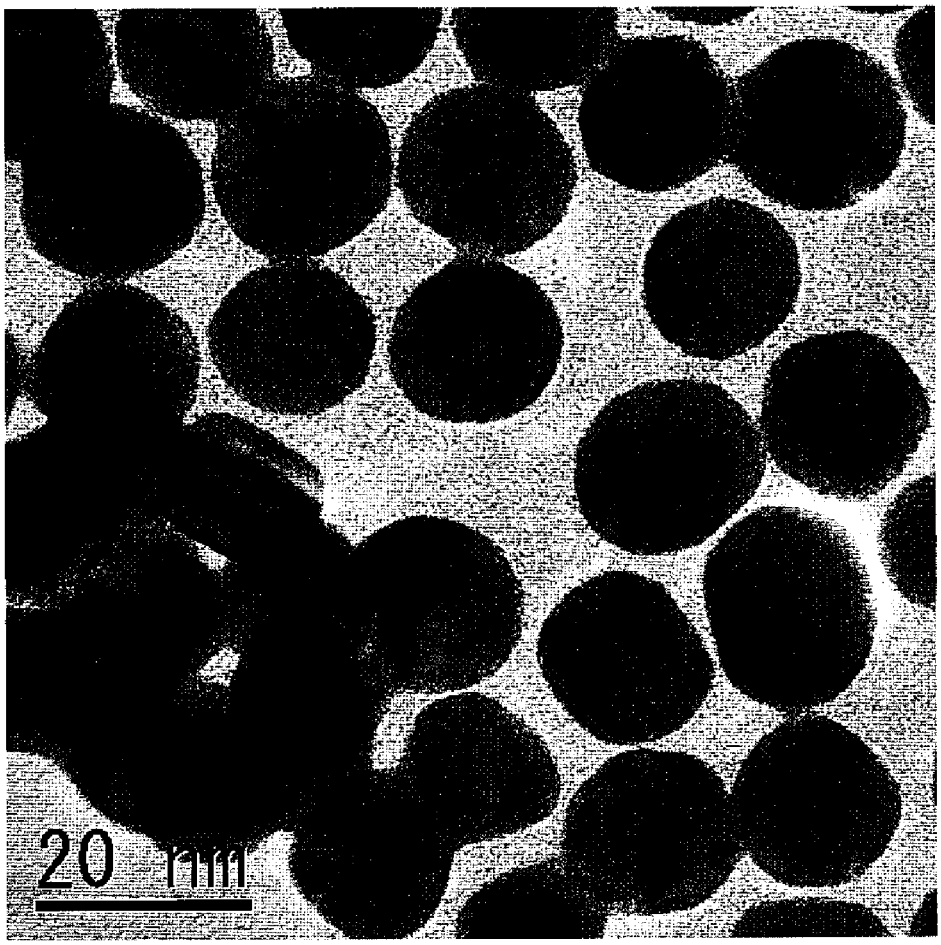
20 nm

PRETREATMENT SOLUTION FOR ELECTROLESS PLATING AND ELECTROLESS PLATING METHOD

CROSS-REFERENCE TO RELATED APPLICATION

This is a PCT National Phase of PCT/JP2015/066849 filed on Jun. 11, 2015, which claims priority of Japanese Patent Application No. 2014-146691 filed on Jul. 17, 2014, the disclosure of which is incorporated herein.

TECHNICAL FIELD

The present invention relates to a pretreatment solution that is used for pretreatment in electroless plating and an electroless plating method using the pretreatment solution, in particular, a pretreatment solution that allows formation of a fine circuit on a surface of a nonconductive material and allows formation of a thin film with a uniform thickness over a broad area and an electroless plating method using the pretreatment solution.

BACKGROUND ART

Conventionally, electroless plating is broadly used as an industrial method for directly forming a film of a base metal, such as nickel (Ni), copper (Cu), or cobalt (Co), or a base metal alloy or a noble metal, such as silver (Ag), gold (Au), platinum (Pt), or palladium (Pd), or a noble metal alloy on a surface of a substrate. As the substrate for electroless plating, various compositions, such as metals, plastics, ceramics, organic compounds, and cellulose, can be used. Specifically, examples of the substrate include films of cellulose, fibroin, polymer resin such as polyester, cellulose triacetate (TAC), and so on; organic compound films of polyimide, polyethylene terephthalate (PET), polyaniline, photocurable resin, and so on; metal plates of copper, nickel, stainless steel, and so on; substrates of ceramics such as alumina, titania, silica, and silicon nitride, quartz glass, and so on; and ITO films. Among these substrates, a material having insulation properties and being difficult to deposit a plating film is usually immersed in a pretreatment solution such that a catalyst for electroless plating adheres to a desired portion of the insulating substrate.

As the catalyst for electroless plating contained in this pretreatment solution, a salt of a compound of a noble metal such as gold (Au), palladium (Pd), or platinum (Pt) or a salt of a compound of a base metal such as nickel (Ni) or tin (Sn) is used as metal ions in a pretreatment solution in many cases, but a method using colloid of a noble metal, such as gold (Au), is also known (Patent Literature 1).

The conventional pretreatment solution using noble metal colloid can form a catalytic nuclei of the noble metal colloid on a surface of an insulating substrate. However, in electroless plating, the catalytic nuclei have problems that the plating thickness varies compared to the catalytic nuclei of reduced noble metal ions in a pretreatment solution and that no uniform deposition is obtained. This is caused by that the adhesion to a substrate of catalytic nuclei of noble metal colloid is lower than that of catalytic nuclei of noble metal ions and that the catalytic activity of catalytic nuclei of noble metal colloid is lower than that of catalytic nuclei of reduced noble metal ions.

However, a method using metal ions has disadvantages such as that the number of treatment steps is increased and that the applicable electroless plating bath is limited.

Accordingly, a procedure of reducing a noble metal salt in a pretreatment solution and allowing the formed noble metal colloidal particles to be adsorbed to a substrate has been proposed (Patent Literature 2).

However, the conventional noble metal colloid solution is readily affected by an acid or alkali and has problems that aggregation of nanoparticles in a noble metal colloid solution or desorption of the catalytic nuclei into the electroless plating causes abnormal deposition of a plating film and causes runaway of the electroless plating bath, resulting in breakage by used only once.

CITATION LIST

Patent Literature

Patent Literature 1: Japanese Patent No. 4649666

Patent Literature 2: Japanese Patent Laid-Open No. 1-319683

SUMMARY OF INVENTION

Technical Problem

In order to solve the above-mentioned problems, the present inventors have investigated pretreatment solutions that allows noble metal colloid to be stably dispersed in every pH region, to be uniformly adsorbed to a surface of a substrate, and to form a plating film having a uniform thickness in a broader area by electroless plating. As a result, the inventors have found that a sugar alcohol can protect and uniformly disperse noble metal nanoparticles in water and also allows the noble metal nanoparticles to be uniformly adsorbed to a surface of a substrate and have arrived at the present invention.

The object of the present invention is to provide a pretreatment solution that functions as stable catalytic nuclei to an electroless plating bath in every pH region. Another object of the present invention is to provide a pretreatment solution that allows formation of a fine circuit and formation of a thin film having a uniform thickness over a broad area and can uniformly disperse noble metal nanoparticles to a substrate. Another object of the present invention is to provide an electroless plating method using the pretreatment solution.

Solution to Problem

One of pretreatment solutions for electroless plating of the present invention for solving the above-mentioned problems is composed of noble metal colloidal nanoparticles, a sugar alcohol, and water. The pretreatment solution for electroless plating is characterized in that the colloidal nanoparticles are of gold (Au), platinum (Pt), or palladium (Pd), have an average particle diameter of 5 to 80 nm, and are contained in the pretreatment solution in an amount of 0.01 to 10 g/L as the metal mass, that the sugar alcohol is at least one selected from the group consisting of tritol, tetritol, pentitol, hexitol, heptitol, octitol, inositol, quercitol, and pentaerythritol and is contained in the pretreatment solution in an amount of 0.01 to 200 g/L in total, and that the remainder is water.

Another pretreatment solution for electroless plating of the present invention for solving the above-mentioned problems is composed of noble metal colloidal nanoparticles, a sugar alcohol, a pH adjuster, and water. The pretreatment solution for electroless plating is characterized in that the colloidal nanoparticles are of gold (Au), platinum (Pt), or palladium (Pd), have an average particle diameter of 5 to 80 nm, and are contained in the pretreatment solution in an amount of 0.01 to 10 g/L as the metal mass, that the sugar alcohol is at least one selected from the group consisting of tritol, tetritol, pentitol, hexitol, heptitol, octitol, inositol, quercitol, and pentaerythritol and is contained in the pretreatment solution in an amount of 0.01 to 200 g/L in total, that the pH adjuster is contained in the pretreatment solution in an amount of 1 g/L or less, and that the remainder is water.

In the electroless plating method of the present invention for solving the above-mentioned problems, a substrate is immersed in a pretreatment solution and is then electroless plated. The electroless plating method is characterized in that the pretreatment solution used is composed of noble metal colloidal nanoparticles, a sugar alcohol, a pH adjuster, and water, that the colloidal nanoparticles are of gold (Au), platinum (Pt), or palladium (Pd), have an average particle diameter of 5 to 80 nm, and are contained in the pretreatment solution in an amount of 0.01 to 10 g/L as the metal mass, that the sugar alcohol is at least one selected from the group consisting of tritol, tetritol, pentitol, hexitol, heptitol, octitol, inositol, quercitol, and pentaerythritol and is contained in the pretreatment solution in an amount of 0.01 to 200 g/L in total, that the pH adjuster is contained in the pretreatment solution in an amount of 1 g/L or less, and that the remainder is water.

In the pretreatment solution for electroless plating of the present invention, the prescribed sugar alcohol is limited to at least one selected from the group consisting of tritol, tetritol, pentitol, hexitol, heptitol, octitol, inositol, quercitol, and pentaerythritol. This is because that these sugar alcohols surround the noble metal nanoparticles and protect the noble metal nanoparticles from heated aqueous solutions in every pH region. These sugar alcohols are heat resistant and do not change the dissociation states regardless of the acidic and alkaline conditions. Consequently, the sugar alcohols function as protective agents for noble metal nanoparticles at every pH condition. Accordingly, even in a strong acid or alkali electroless plating bath, the surface morphology of the noble metal nanoparticles is maintained until electroless plating is started by charging a reducing agent.

The pretreatment solution contains 0.01 to 200 g/L of a prescribed sugar alcohol, which arranges the noble metal nanoparticles at equal intervals on a surface of a substrate. As long as the concentration is within this range, formation of a fine circuit and formation of a thin film having an uniform thickness over a broad area are possible, even if the concentration of the prescribed sugar alcohol is diluted or several tens substrates are repeatedly immersed in the same pretreatment solution. This suggests that a sugar alcohol in a prescribed concentration range combines the solid substrate surface and the solid noble metal nanoparticles in an aqueous solution, but does not combine between the solid noble metal nanoparticles and that, as a result, the noble metal nanoparticles are two-dimensionally arranged at equal intervals on the substrate surface to form catalytic nuclei.

If the concentration of the prescribed sugar alcohol is less than 0.01 g/L, a fine circuit or a thin film having a uniform thickness over a broad area cannot be readily formed. Accordingly, the lower limit of the concentration of the prescribed sugar alcohol is determined to be 0.01 g/L. The upper limit is 200 g/L. If the concentration of the prescribed sugar alcohol is higher than this value, unnecessary free catalytic nuclei are formed in the electroless plating bath, leading to easy occurrence of a runaway reaction. As long as the concentration of the prescribed sugar alcohol is within a range of 0.01 to 200 g/L, the anchor effect on the insulating substrate is not lost until the start of electroless plating, and the activity as a catalytic nucleus for the electroless plating solution is also not lost.

In the pretreatment solution for electroless plating of the present invention, the colloidal nanoparticles are of gold (Au), platinum (Pt), or palladium (Pd). These nanoparticles function as stable catalytic nuclei on an electroless noble metal (such as gold (Au), silver (Ag), platinum (Pt), or palladium (Pd)) plating bath or on an electroless base metal (such as cobalt (Co), copper (Cu), nickel (Ni), or iron (Fe)) plating bath. The noble metal nanoparticles stably maintain the shape in such a plating bath and therefore show uniform catalytic activity, allowing formation of a fine circuit.

In particular, in noble metal nanoparticles chemically reduced in a sugar alcohol, surface deposition morphology of fine spherical particles of 1 nm or less are observed on the surfaces of the noble metal nanoparticles. The FIGURE shows specific surface morphology. That is, in the transmission electron microscope photograph shown in the FIG. 1, a large number of fine spherical particles like a bunch of grapes is observed on a surface of one nanoparticle. This is called "picocluster". The picocluster on the surface of a nanoparticle does not depend on the type of the noble metal. Even if the concentration of the noble metal nanoparticles in a pretreatment solution is low, this template effect allows the catalytic nuclei of the noble metal nanoparticles to exhibit higher performance and enables formation of a finer circuit.

The colloidal nanoparticles are contained in the pretreatment solution in an amount of 0.01 to 10 g/L as the metal mass. As described above, even if the concentration in the pretreatment solution is low, the noble metal nanoparticles exhibit the performance of the catalytic nuclei. However, the lower limit of the concentration is determined to be 0.01 g/L. If the concentration is less than 0.01 g/L, the pretreatment solution must be made every time, which takes a lot of time and effort. The upper limit of the concentration is determined to be 10 g/L. Since this treatment agent shows a strong anchor effect on an insulating substrate, a concentration higher than this value requires much time and effort to wash the substrate with water after the immersion in the pretreatment solution.

The colloidal nanoparticles have an average particle diameter of 5 to 80 nm. In this range, the performance of the catalytic nuclei of the noble metal nanoparticles can be practically exhibited according to the type and properties of the electroless plating solution. A pretreatment solution containing noble metal nanoparticles has been already known, but the noble metal nanoparticles disappear at the time when they are immersed in an electroless plating bath. That is, even if the noble metal nanoparticles are uniformly dispersed on the surface of a substrate, the noble metal nanoparticles are dissolved before starting the electroless plating. Therefore, no performance of the catalytic nuclei as solid nanoparticles is exhibited. In the present invention, the uniformly dispersed noble metal nanoparticle clusters remain until a reducing agent is charged into an electroless plating bath. Accordingly, it is possible to select an average particle diameter of the colloidal nanoparticles suitable for the electroless plating solution.

If the average particle diameter of the noble metal nanoparticles is less than 5 nm, the starting point of deposition of the electroless plating is not settled, and runaway of electroless plating readily occurs. In contrast, if the average particle diameter of the noble metal nanoparticles is larger than 80 nm, uniform dispersion is difficult, leading to a difficulty in formation of a fine circuit. When the colloidal nanoparticles have an average particle diameter of 5 to 80 nm, picoclusters in a spherical form can be formed at equal intervals on the surface of each noble metal colloidal nanoparticle chemically reduced in a sugar alcohol.

The pretreatment solution for electroless plating of the present invention contains 1 g/L or less of a pH adjuster for preventing the surface of the substrate from being deteriorated. In particular, if an acid or alkali is used at high temperature and high concentration on the surface of an organic polymer substrate, the properties of the substrate may be deteriorated. Nevertheless, in the present invention, the substrate surface is preferably subjected to pretreatment, such as hydrophilization, in advance before the substrate is immersed in the pretreatment solution for electroless plating of the present invention.

The reaction mechanism of the electroless plating in the present invention is presumed as follows. Electroless plating is started by charging a reducing agent into an electroless plating bath, and the protective effect of the sugar alcohol is lost by the contact and reaction of the reducing agent, leading to dispersion of the sugar alcohol surrounding the noble metal nanoparticles in the electroless plating bath. The exposed surfaces of the noble metal nanoparticles have activity. In particular, presence of picocluster surfaces enhances the activity. Accordingly, the noble metal nanoparticle clusters arranged on the surface of the substrate function as catalytic nuclei sites in electroless plating, and metal deposition in the electroless plating starts using the sites as the starting points. The picocluster surface formed on the noble metal nanoparticle enhances the adhesion between the substrate and the deposited metal by the anchor effect of the picocluster surface.

Preferred embodiments of the pretreatment solution to be used in the electroless plating method of the present invention, in addition to the above-described case, are as follows. The picoclusters are preferably an atomic-level size of the noble metal element constituting the picoclusters themselves and are preferably self-aligned at equal intervals. The reduced and deposited electroless plating metal starts to grow along the templates with refinement of the surfaces of catalytic nuclei, allowing formation of a fine circuit.

The colloidal nanoparticles preferably have an average particle diameter of 10 to 40 nm. An average particle diameter less than 10 nm makes the colloidal nanoparticles too fine, resulting in a reduction in the catalytic effect and also a reduction in the activity on the plating solution. In contrast, an average particle diameter larger than 40 nm makes the formation of a fine circuit difficult.

The amount of the sugar alcohol is preferably 0.1 to 20 g/L. In order to prevent remaining of the unnecessary sugar alcohol on the surface of a substrate after the completion of reaction, the concentration of the sugar alcohol is desired to be as low as possible. Accordingly, the concentration is preferably 20 g/L or less. Since a concentration of less than 0.1 g/L restricts the number of repeating use, the lower limit is preferably 0.1 g/L.

It is preferable that the colloidal nanoparticles are preferably platinum (Pt) nanoparticles and that the sugar alcohol is at least one selected from glycerin, erythritol, xylitol, inositol, and pentaerythritol. It has been experimentally demonstrated that a combination of platinum (Pt) nanoparticles with glycerin, erythritol, xylitol, inositol, or pentaerythritol is beneficial.

It is also preferable that the colloidal nanoparticles are of palladium (Pd) and that the sugar alcohol is at least one of glycerin, erythritol, xylitol, and mannitol. Similarly, it has been experimentally demonstrated that a combination of palladium (Pd) nanoparticles and glycerin, erythritol, xylitol, or mannitol is beneficial.

It is also preferable that the colloidal nanoparticles are of gold (Au) and that the sugar alcohol is at least one of glycerin, erythritol, xylitol, mannitol, and pentaerythritol. Similarly, it has been experimentally demonstrated that a combination of gold (Au) nanoparticles and glycerin, erythritol, xylitol, mannitol, or pentaerythritol is beneficial.

In the electroless plating method of the present invention, the pretreatment solution has heat resistance and acid and alkali resistance, due to the effect of a prescribed sugar alcohol. Accordingly, the pretreatment solution is not affected by pH of the pretreatment solution. In addition, even if a reducing agent is added to the pretreatment solution and the pretreatment solution is then left to stand for several ten days, the ability of forming catalytic nuclei on a substrate is not deteriorated. Thus, the pretreatment solution is stable. Furthermore, the pretreatment solution can exhibit an anchor effect of the noble metal nanoparticles to a substrate, even if the pretreatment solution does not contain any surfactant that is usually used for improving wettability.

The type of the pretreatment solution of the present invention is the simplest one composed of noble metal nanoparticles, a sugar alcohol, and water or the simplest pretreatment solution containing a pH adjuster. However, in a case of chemically reducing the noble metal nanoparticles with a reducing agent in the sugar alcohol, the reducing agent remains in the pretreatment solution. Examples of the reducing agent used herein include weak reducing agents, such as trisodium citrate, sodium hypophosphite, oxalic acid, and tartaric acid, and reducing agents, such as hydrogen peroxide, hydrazine ($H_2N—NH_2$), and sodium borohydride.

The pretreatment solution for electroless plating of the present invention preferably contains pure water. Pure water does not interact with sugar alcohols and reducing agents for the noble metal nanoparticles. Ultrapure water can retain the protective effect of sugar alcohols and is more preferred than pure water.

The electroless plating method of the present invention includes a step of washing the substrate immersed in a pretreatment solution for completely removing the pretreatment solution remaining of the substrate surface. In a substrate of a polymer resin, since the bonding between a sugar alcohol and the substrate is relatively strong, the noble metal nanoparticles may remain on the surface of the substrate even if the substrate is washed with water for all day and night. If unnecessary noble metal nanoparticles of the pretreatment solution of the present invention remain due to insufficient washing with water, unnecessary catalytic nuclei are formed during electroless plating to cause runaway of the electroless plating bath. The washing step is generally performed with flowing water, but may be performed by mechanical brushing.

In the electroless plating method of the present invention, the electroless plating bath may be a commercially available plating bath. The pretreatment solution adsorbed to, for example, an insulating substrate has a strong anchor effect. Therefore, even if the substrate is subjected to the washing step, the substrate in the electroless plating bath is stable until metal reduction is started.

In the electroless plating method of the present invention, picoclusters are preferably in a size similar to the atomic-level size of the noble metal element constituting the picoclusters themselves and are preferably self-aligned at equal intervals. Because the number of catalytic sites increases with refinement of the catalytic nuclei, and the reduced metal starts to uniformly grow along the catalytic nuclei, allowing formation of a fine circuit.

In the electroless plating method of the present invention, the component of the nanoparticles of the pretreatment solution is preferably the same as the metal component of the electroless plating bath. Because the use of the same metal component allows continuous deposition and growth of the noble metal component of the electroless plating bath using the picocluster surfaces of the colloidal nanoparticles adsorbed to the substrate as templates.

In the electroless plating method of the present invention, the pH of the pretreatment solution is preferably the same as that of the electroless plating bath. The same pH levels can maintain the anchor effect of the colloidal nanoparticles adsorbing to the substrate.

In the electroless plating method of the present invention, the substrate preferably has a surface modified by ultraviolet irradiation. For example, treatment of a surface of a silicone semiconductor substrate with a silane coupling agent forms a ceramic substrate having, for example, amine terminal groups evenly arranged on the surface. A fine circuit is formed on this substrate with a quartz photomask and is then irradiated with ultraviolet light. As a result, noble metal nanoparticles are adsorbed to the portion not irradiated with the ultraviolet light. Similarly, a circuit can be formed by irradiating a print circuit substrate of an epoxy resin with ultraviolet light.

Advantageous Effects of Invention

In the pretreatment solution for electroless plating of the present invention, the sugar alcohol surrounds the noble metal nanoparticles. Consequently, the noble metal nanoparticles have resistance to heat and resistance to chemicals such as strong acids and strong alkalis. In addition, the prescribed sugar alcohol surrounding the nanoparticles does not modify the dispersion state of the noble metal nanoparticles, and the colloidal condition is maintained. The prescribed sugar alcohol surrounding the nanoparticles is stable, and thereby the pretreatment solution for electroless plating of the present invention is stable for a long period of time and can retain the shape of the noble metal nanoparticles until the start of electroless plating. The prescribed sugar alcohol surrounding the nanoparticles does not modify the dissociation state against an acid or an alkali and can therefore retain the pretreatment solution for every aqueous solution in all range of pH. Accordingly, the composition of the pretreatment solution can be tuned in accordance with the bath composition of the electroless plating bath to be used.

The sugar alcohol surrounding the nanoparticles allows the noble metal nanoparticles to strongly adsorb to any substrate regardless of the type of the substrate. Furthermore, the sugar alcohol has excellent dispersability, the distance between the noble metal nanoparticles adsorbed to a substrate is broad, and the subsequent noble metal nanoparticles do not adsorb to the surfaces of the noble metal nanoparticles. That is, the noble metal nanoparticles can be two-dimensionally arranged and dispersed on the substrate by appropriately setting the particle diameter of the noble metal nanoparticles, which become catalytic nuclei, in accordance with the electroless platting solution to be used.

The sugar alcohol surrounds the noble metal nanoparticles even after adsorption to a substrate. Consequently, the noble metal nanoparticles can retain the shape of the noble metal nanoparticles until electroless plating is started after immersion by charging a reducing agent into the electroless plating bath. For example, even if the noble metal nanoparticles covered with the sugar alcohol are dried after adsorption to a substrate, an electroless plating reaction can be started by immersing the noble metal nanoparticles in an electroless plating solution. Even if the noble metal nanoparticles covered with the sugar alcohol are dried, the nanoparticles do not aggregate. That is, even if the pretreatment solution containing noble metal nanocolloid is dried, metal particle formation due to aggregation does not occur. Accordingly, even if the pretreatment solution is partially concentrated by, for example, moisture evaporation, metal particles are not generated in a vicinity of the liquid surface contact wall of the pretreatment layer. Moreover, since the pretreatment solution for electroless plating can be repeatedly used, catalytic nuclei can be repeatedly formed on a large number of substrates. Accordingly, the pretreatment solution for electroless plating of the present invention can be incorporated into an automated line of electroless plating.

Furthermore, the sugar alcohol surrounding the noble metal nanoparticles has resistance to heat and resistance to chemicals such as strong acids and strong alkalis and can accordingly be used in pretreatment of every commercially available electroless plating solution. The noble metal nanoparticles chemically reduced in the sugar alcohol form picoclusters. The picocluster structure of the noble metal nanoparticles has a chemically reduced active site and thereby has a high activity, resulting in enhancement of the adhesion with a substrate and of the catalytic effect.

The electroless plating method of the present invention provides the above-described effects of the pretreatment solution for electroless plating and also the following effects independently or redundantly. Since the solid noble metal nanoparticles can be provided at the start of electroless plating, catalytic nuclei having a constant shape are always provided. Accordingly, circuits having a narrow circuit width can be formed on a substrate, and also a thin film having a uniform thickness over a broad area can be formed. Furthermore, in the surfaces of the catalytic nuclei, the surfaces of the solid noble metal nanoparticles are exposed by dispersion of the sugar alcohol, leading to a high activity and stable quality of a plating film.

In a case of noble metal nanoparticles chemically reduced in the sugar alcohol, the picocluster formed on the surface of a noble metal nanoparticle functions as a template for depositing a metal reduced from the electroless plating bath on the picocluster surface. This template effect allows a plating film to grow with a steep edge on a sub micrometer order.

On the other hand, the concentration of free sugar alcohol, generated by the start of electroless plating, in the electroless plating bath is significantly low. Therefore, the free sugar alcohol does not bind to the reduced metal atom of the electroless plating. The noble metal nanocolloid of the present invention is strongly adsorbed to a substrate and does not desorb even if sufficient washing is performed after the pretreatment. Accordingly, even if electroless plating is repeatedly carried out for many substrates with an automated electroless plating line, abnormal deposition of free sugar alcohol does not occur, resulting in prevention of runaway of the plating bath.

BRIEF DESCRIPTION OF DRAWING

The FIGURE shows a transmission electron microscope photograph of gold (Au) nanoparticles having a particle diameter of 20 nm according to the present invention.

EXAMPLES

Preferred examples of the present invention will now be described.

[1] Preparation of Pretreatment Solution

Example 1

Sodium tetrachloroaurate(III) tetrahydrate (0.1 g/L in terms of concentration of gold (Au)) and xylitol (1.0 g/L) were dissolved in an aqueous sodium hydroxide solution (pH: 12) at 90° C. The solution was reduced with trisodium citrate dihydrate to prepare a gold (Au) colloid solution. The gold (Au) nanoparticles had an average particle diameter of 20 nm, and 90% or more of the nanoparticles had a particle diameter in the range of 10 to 30 nm (d=20±10 nm). Gold (Au) nanoparticles having a particle diameter of 20 nm were inspected with a transmission electron microscope (JEM-2010, manufactured by JEOL Ltd.). The transmission electron microscope photograph is shown in the FIGURE. As obvious from this photograph, picoclusters were in a size similar to the atomic-level size of gold (Au) and were self-aligned at equal intervals on the surfaces of the gold (Au) nanoparticles.

Subsequently, the resulting gold (Au) colloid solution was dispersed in an aqueous solution of 1N hydrochloric acid, sulfuric acid, or potassium hydroxide at 80° C. A transmission electron microscope photograph of each dispersion was similarly inspected, and no change in the surface property of the gold (Au) nanoparticles was observed. Separately, the gold (Au) colloid solution was dispersed in an aqueous sodium hydroxide solution (pH: 12) at 30° C. Even after 150 hours, similarly, no change in the surface property of the gold (Au) nanoparticles was observed.

Example 2

Gold (Au) colloid solutions were prepared as in Example 1, except that the amount of the sodium tetrachloroaurate (III) tetrahydrate was 1 g/L, 5 g/L, or 9 g/L in terms of concentration of gold (Au) and the amount of the xylitol was 15 g/L, 0.5 g/L, or 150 g/L, respectively. The resulting gold (Au) nanoparticles had a particle diameter d of 20±10 nm, 30±10 nm, and 50±20 nm, respectively, for the amounts of 1 g/L, 5 g/L, and 9 g/L in terms of concentration of gold (Au).

Example 3

The same experiment as Example 1 was carried out using mannitol, glycerin, or erythritol instead of xylitol to prepare gold (Au) colloidal nanoparticles respectively having a particle diameter d of 20±10 nm, 20±10 nm, and 20±10 nm. The resulting gold (Au) colloid solutions were each dispersed in an aqueous solution of 1N hydrochloric acid, sulfuric acid, or potassium hydroxide at 80° C., as in Example 1. No change in the surface property of the gold (Au) nanoparticles was observed, as in Example 1.

Example 4

Palladium chloride (0.1 g/L in terms of concentration of palladium (Pd)) and glycerin (50 g/L) were dissolved in an aqueous hydrochloric acid solution (pH: 3) at 90° C. The solution was reduced with sodium hypophosphite to prepare a palladium (Pd) colloid solution. The palladium (Pd) nanoparticles had a particle diameter d of 30±10 nm.

Subsequently, the resulting palladium (Pd) colloid solution was dispersed in an aqueous solution of 1N hydrochloric acid, sulfuric acid, or potassium hydroxide at 80° C. No change in the surface property of the palladium (Pd) nanoparticles was observed, as in Example 1.

Example 5 palladium (Pd) colloid solutions were prepared as in Example 4, except that the amount of the palladium chloride was 1 g/L, 5 g/L, or 9 g/L in terms of concentration of palladium (Pd) and the amount of the glycerin was 0.05 g/L, 4 g/L, or 18 g/L, respectively. The resulting palladium (Pd) nanoparticles had a particle diameter d of 50±20 nm, 30±10 nm, and 30±10 nm, respectively, for the amounts of 1 g/L, 5 g/L, and 9 g/L in terms of concentration of palladium (Pd).

Example 6

The same experiment as Example 4 was carried out using mannitol, xylitol, or erythritol instead of glycerin to prepare palladium (Pd) colloidal nanoparticles respectively having a particle diameter d of 30±10 nm, 40±10 nm, and 30±10 nm. The resulting palladium (Pd) colloid solutions were each dispersed in an aqueous solution of 1N hydrochloric acid, sulfuric acid, or potassium hydroxide at 80° C., as in Example 4. No change in the surface property of the palladium (Pd) nanoparticles was observed, as in Example 4.

Example 7

Hexahydroxoplatinic(IV) acid (0.3 g/L in terms of concentration of platinum (Pt)) and xylitol (1.5 g/L) were dissolved in an aqueous potassium hydroxide solution (pH: 12) at 90° C. The solution was reduced with hydrazine to prepare a platinum (Pt) colloid solution. The platinum (Pt) nanoparticles had a particle diameter d of 30±10 nm. Platinum (Pt) nanoparticles having a particle diameter of 30 nm were inspected with a transmission electron microscope. Picoclusters were in a size similar to the atomic-level size of platinum (Pt) and were self-aligned at equal intervals on the surfaces of the platinum (Pt) nanoparticles.

Subsequently, the resulting platinum (Pt) colloid solution was dispersed in an aqueous solution of 1N hydrochloric acid, sulfuric acid, or potassium hydroxide at 80° C. Similarly, the transmission electron microscope photograph was inspected, and no change in the surface property of the platinum (Pt) nanoparticles was observed.

Example 8

Platinum (Pt) nanoparticles were prepared as in Example 7, except that the amount of the hexahydroxoplatinic(IV) acid was 1.5 g/L, 5 g/L, or 6.5 g/L in terms of concentration of platinum (Pt) and the amount of the xylitol was 4 g/L, 180 g/L, or 16 g/L, respectively. The resulting platinum (Pt) nanoparticles had a particle diameter d of 30±10 nm, 50±20 nm, and 30±10 nm, respectively, for the amounts of 1.5 g/L, 5 g/L, and 6.5 g/L in terms of concentration of platinum (Pt).

Example 9

The same experiment as Example 1 was carried out using sorbitol, mannitol, erythritol, glycerin, or inositol instead of xylitol to prepare platinum (Pt) colloidal nanoparticles respectively having a particle diameter d of 30±10 nm, 60±10 nm, 20±10 nm, 60±10 nm, and 80±10 nm. The resulting platinum (Pt) colloid solutions were each dispersed in an aqueous solution of 1N hydrochloric acid, sulfuric acid, or potassium hydroxide at 80° C., as in Example 7. No change in the surface property of the platinum (Pt) nanoparticles was observed, as in Example 7.

[2] Electroless Plating

Example 10

A 20×20 mm square silicon wafer test piece having a surface provided with $SiO_2$ was subjected to chemical vapor deposition using a silane coupling agent (3-aminopropyl triethoxysilane (trade name: KBE-903)) manufactured by Shin-Etsu Chemical Co., Ltd. under an atmospheric pressure at 75° C. for 5 minutes to form a self-assembled monolayer (SAM) having amine terminal groups, which was used as a substrate.

Twenty of the substrates were immersed in 1000 mL of the gold (Au) colloid solution prepared in Example 1 at 25° C. for 10 minutes. The substrates were each washed with distilled water for 10 minutes. The substrates were then immersed one by one in an auto-catalytic non-cyan electroless gold plating bath (trade name: PRECIOUSFAB ACG 3000WX, gold (Au) concentration: 2 g/L, pH: 7.5) manufactured by Electroplating Engineering of Japan Ltd. at 65° C. for 5 minutes. All of the 20 substrates were plated without causing runaway of the electroless gold plating bath during the plating.

The plating thickness of the resulting gold (Au) plating was measured with a fluorescent X-ray thickness meter (model: SFT-9550) manufactured by Hitachi High-Tech Science Corporation. The average plating thickness of the 20 substrates was 50±5 nm.

Example 11

Ten γ-alumina substrates having a size of 50×50 mm and a thickness of 1 mm were immersed in 1000 mL of the platinum (Pt) colloid solution prepared in Example 7 at 25° C. for 10 minutes. The substrates were each washed with distilled water for 30 minutes. The substrates were then immersed one by one in an electroless platinum plating bath containing 3.4 g/L of dinitro diamino platinum(II) ($Pt(NH_3)_2(NO_2)_2$), 2 mol/Pt mol of polyvinylpyrrolidone, and 1.0 g/L of potassium borohydride ($KBH_4$) and having a pH of 12 at a bath temperature of 90° C. for 30 minutes. All of the 10 substrates were plated without causing runaway of the electroless platinum plating bath during the plating.

The average plating thickness of the resulting platinum (Pt) plating was 1±0.3 μm, and the variation in thickness was low to give uniform films.

Example 12

Twenty gold test pieces having a size of 60×30 mm and a thickness of 0.3 mm were immersed in 500 mL of the palladium (Pd) colloid solution prepared in Example 4. The substrates were each washed with flowing water for 10 minutes and were then immersed one by one in an electroless nickel plating bath (trade name: Lectroless NP7600, nickel (Ni) concentration: 4.8 g/L, pH: 4.6) manufactured by Electroplating Engineering of Japan Ltd. at 85° C. for 20 minutes. All of the 20 substrates were plated without causing runaway of the electroless nickel plating bath during the plating.

The plating thickness of the resulting nickel (Ni) plating was measured with a fluorescent X-ray thickness meter (model: SFT-9550) manufactured by Hitachi High-Tech Science Corporation. The average plating thickness of the 20 substrates was 1.0±0.2 μm, and the variation in thickness was low to give uniform films.

Comparative Example 1

A gold (Au) colloid solution was prepared as in Example 1 except that the amount of sodium tetrachloroaurate(III) tetrahydrate was 12 g/L in terms of concentration of gold (Au). The gold (Au) nanoparticles had a particle diameter d of 80±50 nm. This gold (Au) colloid solution started to aggregate at about 1 hour after the preparation and did not show an activity as a catalytic nucleus for electroless plating.

Comparative Example 2

A gold (Au) colloid solution was prepared as in Example 1 except that the amount of sodium tetrachloroaurate(III) tetrahydrate was 0.005 g/L in terms of concentration of gold (Au). The gold (Au) nanoparticles had a particle diameter d of 40±20 nm, and no picocluster was observed on the surfaces of the gold (Au) nanoparticles. This gold (Au) colloid solution was electroless plated in the bath of Example 10, but no electroless plating was operated.

Comparative Example 3

A palladium (Pd) colloid solution was prepared as in Example 4 except that the amount of glycerin was 250 g/L. The palladium (Pd) nanoparticles had a particle diameter d of 40±20 nm, and no picocluster was observed on the surfaces of the palladium (Pd) nanoparticles. This palladium (Pd) colloid solution was electroless plated in the bath of Example 12, but no electroless plating was operated.

Comparative Example 4

A platinum (Pt) colloid solution was prepared as in Example 7 except that the amount of xylitol was 0.005 g/L. The platinum (Pt) nanoparticles had a particle diameter d of 20±40 nm, and no picocluster was observed on the surfaces of the platinum (Pt) nanoparticles. This platinum (Pt) colloid solution was electroless plated in the bath of Example 11, but no electroless plating was operated.

Conventional Example 1

An aqueous solution containing polyvinylpyrrolidone K25 (0.05 g/L), tetrachloroaurate(III) tetrahydrate (0.1 g/L in terms of concentration of Au), and sodium citrate dihydrate (0.5 g/L) was stirred at 90° C. for 30 minutes to prepare an Au colloid containing polyvinylpyrrolidone as a dispersant. This Au colloid solution was subjected to electroless gold plating as in Example 10, but no electroless plating was operated.

INDUSTRIAL APPLICABILITY

The pretreatment solution for electroless plating of the present invention can be applied to every commercially available electroless plating solution. The electroless plating method can be applied to, for example, a variety of sensors, such as an optical sensor, a hydrogen gas detection sensor, an air pressure sensor, and a water depth sensor, and electrodes of wiring substrates.

The invention claimed is:

1. A pretreatment solution for electroless plating, comprising noble metal colloidal nanoparticles, a sugar alcohol, and water, wherein the colloidal nanoparticles are platinum nanoparticles, and have an average particle diameter of 5 to 80 nm, and are contained in the pretreatment solution in an amount of 0.01 to 10 g/L as metal mass;

the sugar alcohol is at least one selected from the group consisting of glycerin, erythritol, xylitol, inositol, or pentaerythritol and is contained in the pretreatment solution in an amount of 0.01 to 200 g/L in total; and the remainder is water.

2. A pretreatment solution for electroless plating, comprising noble metal colloidal nanoparticles, a sugar alcohol, and water, wherein the colloidal nanoparticles are palladium, and have an average particle diameter of 5 to 80 nm, and are contained in the pretreatment solution in an amount of 0.01 to 10 g/L as metal mass;

the sugar alcohol is at least one selected from the group consisting of glycerin, erythritol, xylitol, or mannitol and is contained in the pretreatment solution in an amount of 0.01 to 200 g/L in total; and the remainder is water.

3. A pretreatment solution for electroless plating, comprising noble metal colloidal nanoparticles, a sugar alcohol, and water, wherein the colloidal nanoparticles are gold, and have an average particle diameter of 5 to 80 nm, and are contained in the pretreatment solution in an amount of 0.01 to 10 g/L as metal mass;

the sugar alcohol is at least one selected from the group consisting of glycerin, erythritol, xylitol, mannitol, or pentaerythritol and is contained in the pretreatment solution in an amount of 0.01 to 200 g/L in total; and the remainder is water.

* * * * *